United States Patent [19]

Kent

[11] Patent Number: 4,540,030

[45] Date of Patent: Sep. 10, 1985

[54] APPARATUS FOR COMPACTING LOOSE WRAPS OF WIRE ON TERMINALS

[75] Inventor: William C. Kent, Garland, Tex.

[73] Assignee: AT&T Technologies, Inc., New York, N.Y.

[21] Appl. No.: 593,217

[22] Filed: Mar. 27, 1984

[51] Int. Cl.[3] ..... H01F 41/10; B21F 45/00

[52] U.S. Cl. ..... 140/93 R; 29/748; 140/113

[58] Field of Search ..... 29/748, 857; 140/93 R, 140/111, 113, 71 R, 71 C

[56] References Cited

U.S. PATENT DOCUMENTS 2,988,234 6/1961 Barothy et al. .

*Primary Examiner*—Carl E. Hall

*Attorney, Agent, or Firm*—R. P. Miller; M. de Picciotto

[57] ABSTRACT

A work piece 10 with projecting terminals 16, 17 and 18 on which are wrapped loose turns of wire 19, 20 and 21 is advanced into and held between arms of a yoke 30. Upper ends of the terminals are positioned between jaws 36, 37 and 38. A cam plate 49 is initially moved by fluid cylinders 53 and 54 to move V-shaped cam surfaces 48 against the jaws which partially close about the terminals. Next, fluid cylinders 65 and 66 are operated to move a slide 60 on which the jaws are mounted so that the now partially closed jaws engage and compact the loose wraps of wire against the work piece. Finally, the yoke 30 is withdrawn to permit stationary knockout pins 76 to dislodge the work piece into a discharge chute 79.

8 Claims, 9 Drawing Figures

FIG. 1
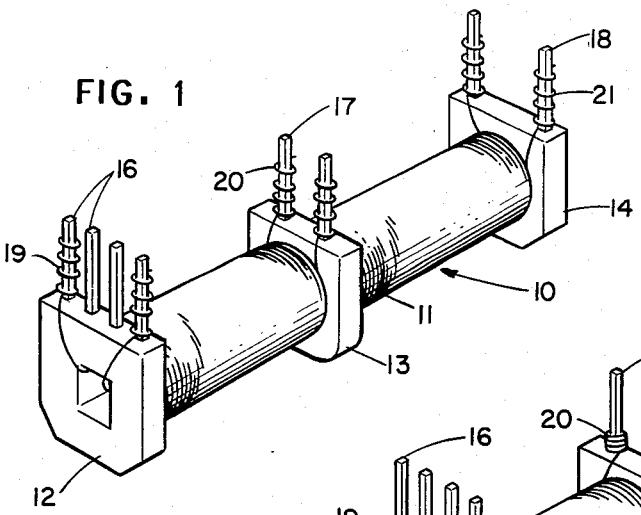
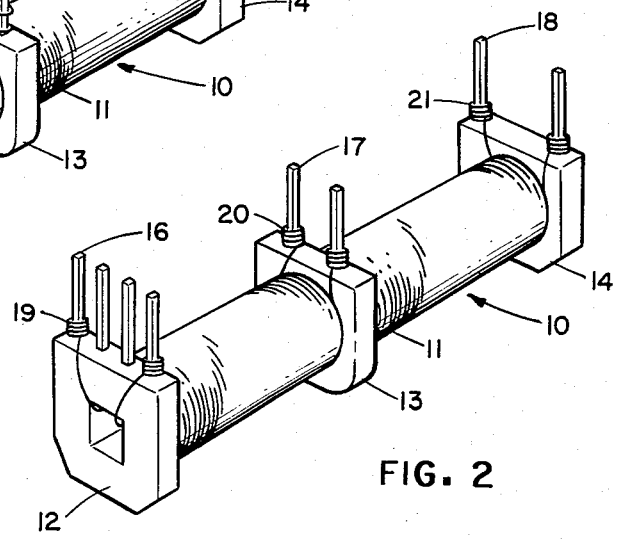
FIG. 2
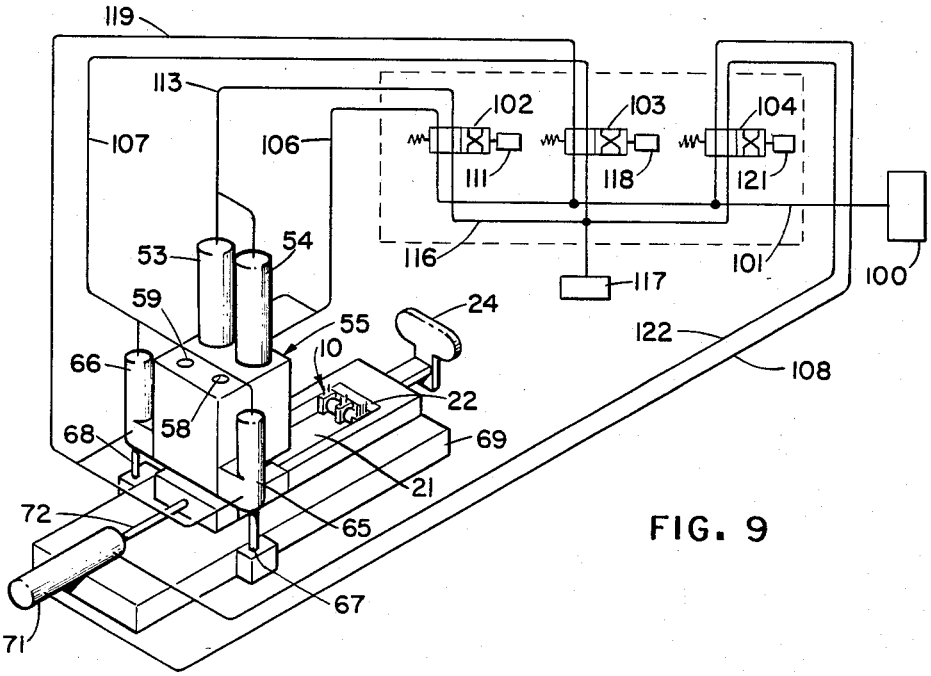
FIG. 9

APPARATUS FOR COMPACTING LOOSE WRAPS OF WIRE ON TERMINALS

FIELD OF INVENTION

This invention relates to apparatus for performing a work operation on an element coaxially positioned with respect to a second element and more particularly to an apparatus for compacting loose wire wraps coaxially positioned about terminals projecting from a coil form.

BACKGROUND OF THE INVENTION

In the manufacture of several types of coil devices such as transformers, ferrod coil sensors, etc. automatic wiring machines are utilized in which first ends of wires are loosely wrapped around a first set of terminals projecting from a coil form or arbor and then subsequently wrapped around the body of the coil form. Finally, the trailing second ends of the wires are loosely wrapped around a second set of terminals projecting from the coil form. By loosely wrapped, it is meant that the convolutions of wire wrapped about the terminals are widely spaced apart. Prior to subsequent use or assembly of the wrapped coil form, it is necessary that the loose convolutions of the wire be compacted against the coil form so that terminal sections free of wire wraps are exposed. The wire wrap free sections of terminals then may be attached to or within an electrical utilization device such as a telephone matrix switch.

SUMMARY OF INVENTION

This invention contemplates, among other things, an apparatus for performing a work operation on one of a pair of coaxially located elements without engaging the other element.

More particularly, an article such as a coil form with a plurality of projecting terminals on which are loose coaxial wraps of wire, is positioned between the arms of a yoke holder. The yoke arms have mounted therein a number of spring biased detents that act to hold the article with the terminals positioned between pairs of jaws. Following the gripping of the article within the yoke, a camming device is automatically operated to act against cams formed on the jaws to close the jaws about the terminals in positions so as to encompass the terminals but not actually engaging the terminals. The jaws are mounted on a ram slide which is subsequently operated to slide the jaws along the terminals to compact the loose wire wraps against the coil form. Next, the jaws are opened and the slide ram restored, whereafter the yoke is moved along a path to abut the coil form against ejector pins which function to discharge the coil form from the yoke.

DESCRIPTION OF THE DRAWING

Other features and advantages of the invention will be apparent upon consideration of the following detailed description in conjunction with the drawing wherein:

FIG. 1 is a perspective view of a coil form with projecting terminals about which are wrapped loose coils of wires;

FIG. 2 is a perspective view of the coil form shown in FIG. 1, after the coils are closely compacted by the apparatus forming the subject matter of the present invention;

FIG. 9 is a schematic perspective view of the apparatus together with a showing of a fluid system for controlling the operation of the various component mechanisms of the apparatus.

DETAILED DESCRIPTION

Figure 3:
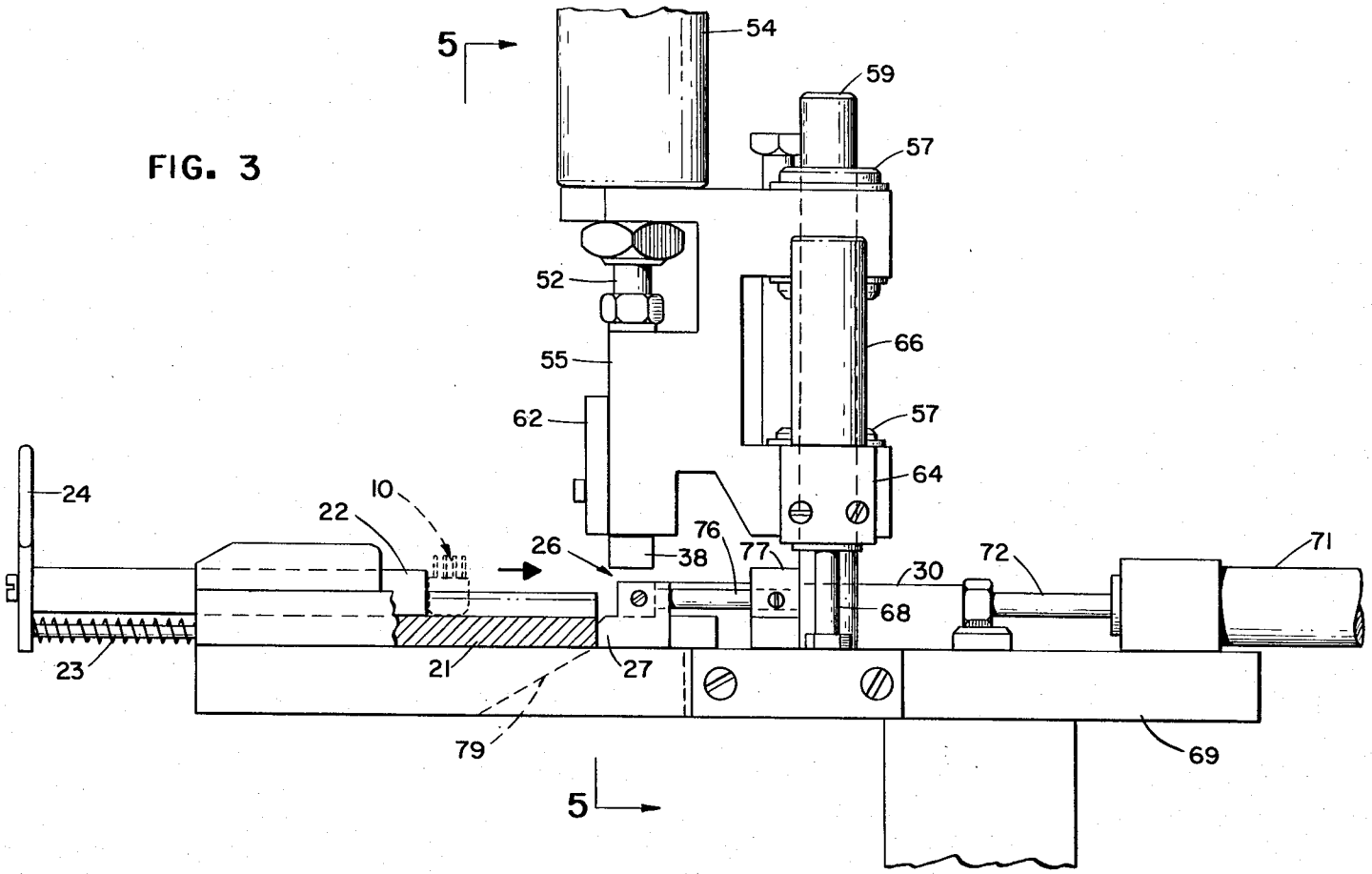
FIG. 3 is a side elevational view, partially cut away, of a loose coil compacting apparatus constructed in accordance with the principles of the present invention.

Considering one specific embodiment of the invention and referring to FIG. 1, there is shown a coil form or bobbin 10 comprising an arbor 11 with three flanges 12, 13 and 14 in which are seated sets of terminals 16, 17 and 18 having loose wraps of wires 19, 20 and 21 that are coaxially coiled about the terminals. This is a common condition of the coil forms after winding wires on the arbor and wrapping the ends of the wires about the terminals in an automatic winding machine. Prior to further fabrication or use of the coil forms, the loose wire wraps 19, 20 and 21 must be compacted against the flanges 12, 13 and 14 to leave wire free terminal end sections on the terminals, as shown in FIG. 2. It is an applied object of the present invention to engage, slide and compact the loose wraps of wire coaxially positioned on the terminals into set positions adjacent to the tops of the coil form flanges.

Figure 4:
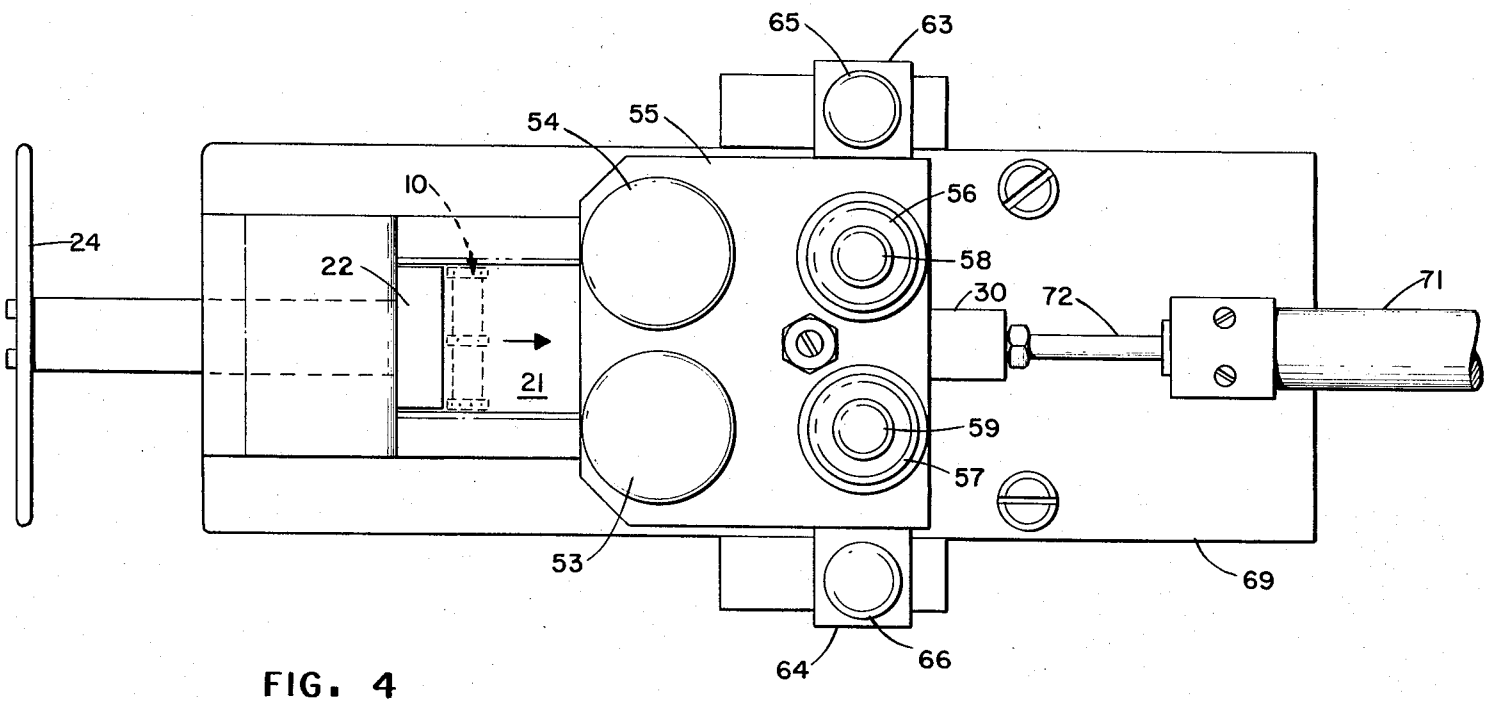
FIG. 4 is a top plan view of the apparatus shown in FIG. 3 particularly illustrating a pusher for advancing a coil form into the apparatus.
Figure 7:
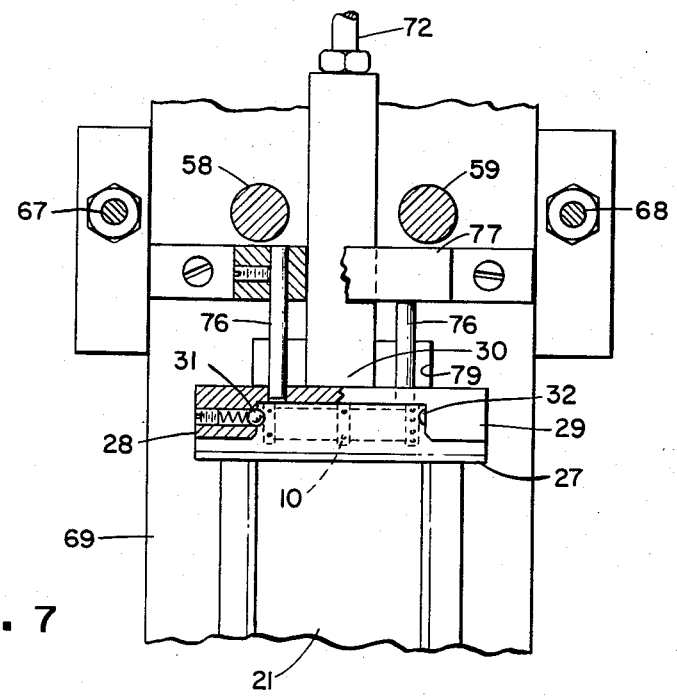
FIG. 7 is a partial sectional view taken along line 7—7 of FIG. 5 depicting a coil form positioned and held in a yoke in anticipation of the coils being compacted.
Figure 8:
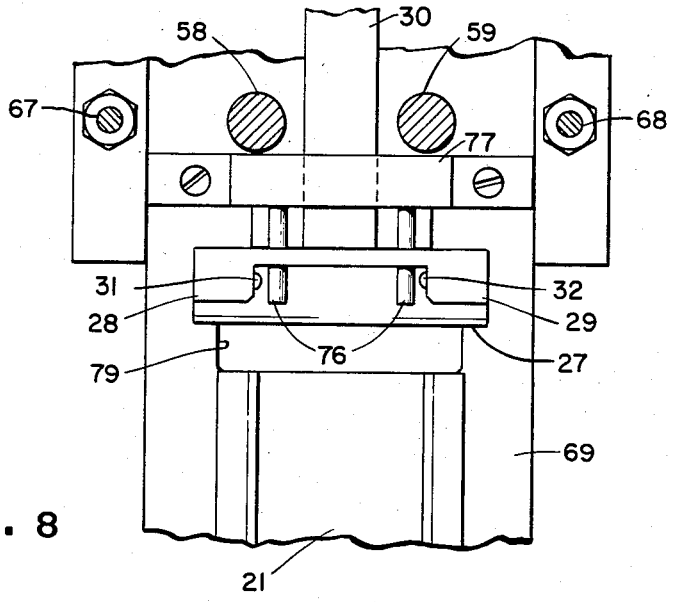
FIG. 8 is a view similar to FIG. 7 depicting the movement of the yoke to strip and discharge a coil form from the yoke.

As shown in FIGS. 3 and 4, a coil form 10 is loaded on the top surface of a guide plate 21 in front of a slide pusher 22 normally maintained in a retracted load position by a spring 23. A handle 24 is grasped by an attending operator and thrust forward to move the slide pusher against the action of the spring 23 so that the coil form is moved into a nest 26 defined by a lower support 27 and a pair of spaced arm members 28 and 29 of a yoke 30 (see FIGS. 7 and 8). The handle is released and the advanced coil form is held in the nest by a pair of spring loaded plungers or ball checks 31 and 32 mounted to project from the members 28 and 29. The slide pusher 22 is returned by the spring 23 and an attending operator may load another coil form 10 in anticipation of the next cycle of operation of the apparatus.

Figure 5:
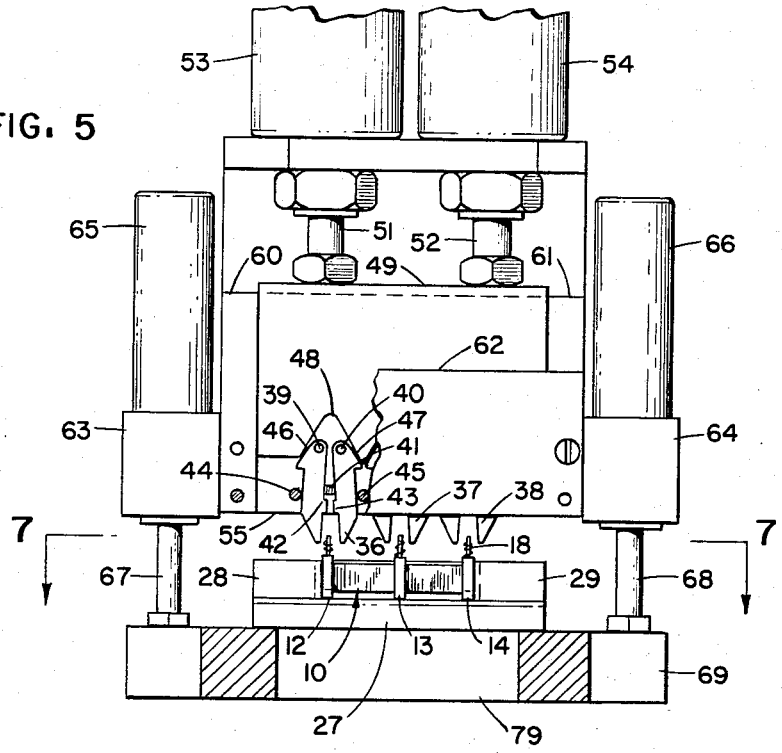
FIG. 5 is a sectional view taken along line 5—5 of FIG. 3 showing an arrangement of cam operated jaws for compacting loose coils.

The terminals 16, 17 and 18 of the advanced coil form are now aligned with three sets of spaced pairs of jaws 36, 37 and 38 (see FIG. 5). At this time, the upper end of the terminals which are free of wire wraps are positioned between the open jaws. Each pair of jaws is pivotally mounted on a pair of stud pins 39 and 40 and is maintained in an open position by a spring 41. The facing surfaces of each pair of jaws are provided with abutments 42 and 43 to limit the extent of closing of the jaws to avoid engagement with and bending of the sets of terminals. Each spring 41 holds each pair of jaws against a pair of stop pins 44 and 45. With such an arrangement, jaw spacings are provided to accommodate the positioned upper ends of the terminals. The upper ends of each pair of jaws are shaped to provide oppositely bevelled cam follower surfaces 46 and 47 adapted to cooperate with V-shaped cam slots 48 formed in a ram slide 49. The ram slide 49 is connected to a pair of piston rods 51 and 52 projecting from a pair of air cylinders 53 and 54. When simultaneously operated, the air cylinders 53 and 54 move the piston rods and the attached ram slide down a distance sufficient to move the V-shaped cams 48 to act on the jaw cam followers to close the jaws about the upper ends of the terminals 16, 17 and 18. The engaged jaw abutments 42 and 43 act to hold a spacing between the jaws 20 so that the terminals are not disturbed or crushed.

Figure 6:
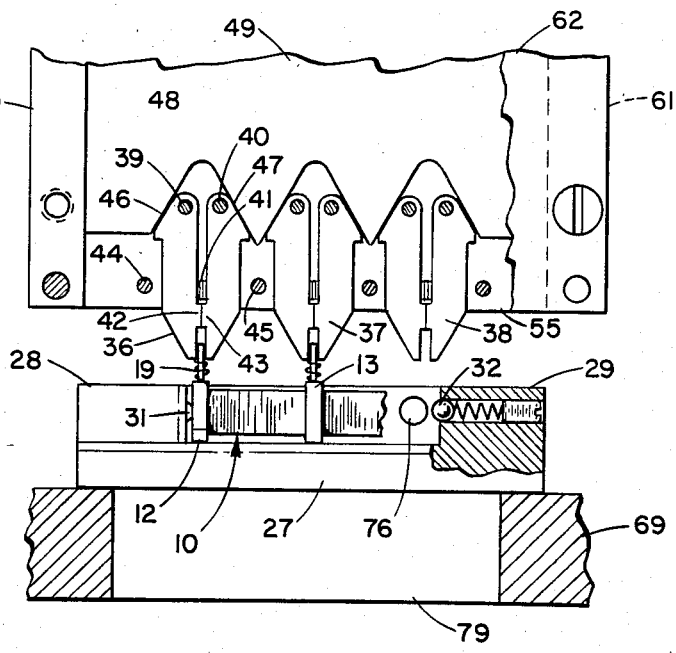
FIG. 6 is a view similar to FIG. 5 showing the jaws in a closed position ready to compact the loose coils.

The jaw assemblies 36, 37 and 38 (see FIGS. 5 and 6) are pivotally mounted by the stud pins 39 and 40 to a frame plate 55. The frame plate includes pairs of bushings 56 and 57 (see FIGS. 3 and 4) journaled on a pair of guide rods 58 and 59 extending from and mounted in a base plate 69. The ram slide 49 is mounted for reciprocating movement between a pair of guide gibs 60 and 61 and a cover plate 62. A pair of cylindrical brackets 63 and 64 are secured to the frame 55 and provide a mounting for a pair of air cylinders 65 and 66 having fluid biased piston rods 67 and 68 which are secured to or act against the base plate 69 to support the frame 55 in an elevated position.

Next, in the sequence of operation, the pair of air cylinders 65 and 66 are operated to move the frame and the jaw assemblies downwardly sufficient distances so that the tips of the jaws engage, push and compact the loose coil wraps 19, 20 and 21 against the upper surfaces of the flanges 12, 13 and 14. The air cylinders 53 and 54 are reversed to move the ram slide 49 and cam surfaces 48 from engagement with the jaws, thus allowing the springs 41 to spread the jaws. Subsequent thereto, the air cylinders 65 and 66 are reversed to lift the jaw assemblies to the original position.

Finally, an air cylinder 71 (see FIGS. 3 and 4) is operated to withdraw a piston rod 72 attached to the yoke 30. Inasmuch as the coil form is being held by the ball checks 31 and 32, the coil form 10 is moved with the yoke. A series of knockout pins 76 are seated in a fixed member 77 secured to the base plate 69. These knockout pins are positioned to engage the now moving coil form which is knocked from the yoke and drops through an opening 79 formed in the base plate 69 and on into a suitable receptacle. While the machine is executing a cycle of operation, another coil form may be loaded on the guide plate 21 in anticipation of the next cycle of the machine.

Briefly recapitulating on the overall operation of the apparatus and referring to FIG. 9, there is schematically shown a fluid control system. In a principal embodiment, it is contemplated that a commercial programmed controller will be utilized to control the execution of a cycle of operation of the apparatus. When a coil form 10 is advanced by the pusher 22 into the yoke nest 26 a switch or other commercial part detector (not shown) is operated to initiate the controller.

As disclosed in FIG. 9 fluid pressure from a source 100 is directed through a distributor line 101 to spring biased shiftable valves 102, 103 and 104, and then over lines 106, 107 and 108 to fluid cylinders 53 and 54, 65 and 66, and 71, respectively to hold the piston rods 51 and 52 (see FIGS. 3 and 5) in withdraw positions and the piston rods 67 and 68, and 72 in forward positions. Upon sensing a coil form held by the yoke 26, the controller is initiated into a cycle of operation and a solenoid 111 is first operated to switch valve 102 to direct the flow of pressurized fluid to operate the cylinders 53 and 54. Pressurized fluid is now applied over a line 113 to the upper ends of the cylinders 53 and 54 while the line 106 is now connected through the valve 102 to an exhaust line 116 running to an exhaust manifold or sump 117. The piston rods 51 and 52 move downwardly to advance the slide ram 49 (see FIGS. 5 and 6) and the cam surfaces 48 to act on the upper cam sections 46 and 47 of the jaws to close the jaws about the terminals. The controller next sends a signal to operate a solenoid 118 to shift valve 103 so that pressurized fluid is applied over a line 119 to the lower ends of the piston 65 and 66. The piston rods 67 and 68 are thus drawn within the cylinders. Inasmuch as the piston rods 67 and 68 are anchored to the base plate 69, the net effect is that the entire frame 55 moves downwardly toward the base plate along the guide rods 58 and 59. The noses of the advancing jaws 36, 37 and 38 engage the upper convolutions of the wire wraps to compact these loose wire wraps against the coil form.

The controller next generates signals to operate the solenoids 118 and 111 to restore the frame 55 and the jaws 36, 37 and 38 to the original start cycle positions. Shortly thereafter, the controller generates a signal to operate a solenoid 121 which functions to shift the valve 104. Pressurized fluid is now applied over a line 122 to the forward end of the cylinder 71. The applied pressurized fluid withdraws the piston rod 72 and the attached yoke 30. As the yoke withdraws, the coil form 10 hits the knockout pins 76 and 77 to dislodge the coil form from the yoke whereupon the coil form falls through the discharge opening 79. Finally, a signal is generated and applied to restore the solenoid 121 and the valve 104 to the original positions so that the yoke 30 is repositioned in anticipation of the next cycle of operation of the apparatus.

Many modifications may be made within the scope of invention. In performing work operations on other coaxially mounted elements, it may be necessary to eliminate the abutments 42 and 43 from the jaw members so that the jaw faces will abut each other when closed about the central elements. In this instance the opposed faces of the jaws are grooved to accommodate the central elements, such as terminals. Instead of a program controller, a series of limit switches and relays may be used to control the sequential operation of the solenoids 111, 118 and 121.

What is claimed is:

1. An apparatus for working on a first element coaxially positioned about a second element projecting from a work piece, which comprises:

a frame plate;

a fluid operated cylinder means having piston means for supporting said frame plate;

a pair of jaws pivotally mounted on said frame plate, said jaws having at least one abutment projecting from one inner jaw surface toward the other inner jaw surface;

resilient means for holding said jaws spaced apart to receive a second element projecting from the work piece;

a cam plate slideably mounted on said frame plate, said cam plate having camming surfaces shaped to engage outer surfaces of said jaws for closing said jaws against the action of said resilient holding means;

means for advancing a work piece to position the second element projecting from said work piece between said jaws;

means responsive to the positioning of the piece for sliding said cam plate to close said jaws about the second element; and means operated subsequent to said sliding means for operating said fluid operated cylinder means to advance said piston means and frame plate to move said jaws along said second element to engage and work upon the first element.

2. An apparatus as defined in claim 1, which comprises:

a yoke having a pair of parallel spaced arms for receiving therebetween an advanced workpiece;

resilient means extending from said arms for engaging and holding a workpiece between the arms.

3. An apparatus as defined in claim 2, which comprises:

means for moving said yoke to withdraw the workpiece; and means positioned in the path of withdrawal of the workpiece for engaging and dislodging the workpiece from said resilient holding means.

4. An apparatus as defined in claim 1, which comprises:

a base plate;

said piston means including a pair of piston rods having ends thereof secured to said base plate;

a pair of guide bushings secured to said frame plate; and a pair of guide rods secured to the base plate and extending through said bushings to guide the frame plate.

5. An apparatus as defined in claim 1, which comprises:

a pair of gibs mounted on said frame plate for guiding said cam plate;

said outer surfaces of said jaws configured to provide a pair of oppositely bevelled surfaces;

means for biasing said jaws into open position to position said oppositely bevelled surfaces adjacent to said camming surfaces on said cam plate; and said cam plate having a V-shaped slot forming said camming surfaces.

6. An apparatus for compacting loose coils of wire wrapped about a terminal extending from a coil form, which comprises:

a base plate for supporting the coil form;

a pusher slideably mounted on the plate for advancing the coil form;

a yoke having a pair of extending arms mounted to receive the coil form advanced by said pusher;

a pair of means projecting from said arms toward each other to hold the advanced coil form within the yoke upon return of the pusher to the original position;

a ram slide;

a pair of jaws pivotally mounted on said ram slide in position to receive the terminal therebetween upon advance of the coil form, said jaws having means for limiting closure of said jaws about the terminal without binding against the terminal;

a cam slideably mounted on said slide ram and having a pair of cam surfaces contoured to engage and close said jaws;

means for moving said cam to close said jaws about the terminal; and means for advancing said slide ram to move said jaws along the terminal to compress the loose coils against the coil form.

7. An apparatus as set forth in claim 6, which includes:

means operative upon advance of said ram for reversing said ram to reopen said jaws;

means for moving the yoke away from said jaws when said jaws are opened; and means rendered effective upon movement of said yoke for engaging and dislodging the coil form from the yoke.

8. An apparatus for working on a number of first compressible elements coaxially positioned about second elements projecting from a work piece, which comprises:

a movably mounted frame plate;

a plurality of pairs of jaws pivotally mounted on said frame plate, each of said pairs of jaws having means for limiting the closure of said jaws to straddle second elements projecting from a work piece, said jaws having cam surfaces thereon for closing said jaws;

resilient means for holding said jaws in open positions;

a camming member slideably mounted on said frame plate, said member having sets of camming surfaces for cooperating with said cam surfaces on said jaws for closing said jaws against the affect of said resilient holding means;

means for moving a work piece to advance the projecting second elements between said pairs of jaws;

means for holding the work piece with the second elements positioned between said sets of jaws;

means responsive to the advance of said work piece for sliding said camming member on said frame plate to move the said sets of camming surfaces to act on said jaw cam surfaces to close said jaws about the second elements;

means operative following closure of said jaws for moving said frame plate to advance said jaws relative to said first elements to work on the second elements without engaging the first elements;

means operative following the work on said second element for restoring said camming member and said frame plate to original positions;

means for moving said work piece holding means to withdraw the second elements from positions between said jaws;

means rendered effective upon movement of said work piece holding means for engaging and ejecting the work piece from the holding means.

* * * * *